US007317444B2

(12) United States Patent
Chang

(10) Patent No.: US 7,317,444 B2
(45) Date of Patent: Jan. 8, 2008

(54) METHOD AND CIRCUIT FOR IMPROVING A QUALITY OF DISPLAY ON AN LCD SCREEN

(75) Inventor: Chung-Hsing Chang, Taoyuan Hsien (TW)

(73) Assignee: Arima Computer Corporation, Taipei (TW)

( * ) Notice: Subject to any disclaimer, the term of this patent is extended or adjusted under 35 U.S.C. 154(b) by 24 days.

(21) Appl. No.: 10/463,476

(22) Filed: Jun. 17, 2003

(65) Prior Publication Data

US 2004/0257326 A1 Dec. 23, 2004

(51) Int. Cl.
*G09G 3/36* (2006.01)

(52) U.S. Cl. ..... 345/102; 345/211

(58) Field of Classification Search ..... 345/102–104, 345/211, 213, 87, 204; 315/307, 219, 169.1
See application file for complete search history.

(56) References Cited

U.S. PATENT DOCUMENTS 6,501,234 B2 * 12/2002 Lin et al. ..... 315/307

* cited by examiner

*Primary Examiner*—Richard Hjerpe
*Assistant Examiner*—Kevin M Nguyen
(74) *Attorney, Agent, or Firm*—Birch, Stewart, Kolasch & Birch, LLP

(57) ABSTRACT

A method and circuit for improving a quality of display on an LAD screen are disclosed. The method is to synchronize a vertical synchronization signal of a video signal supplied to an LAD system with an oscillation signal produced by a burst mode DC-to-AC inverter driving the lamps of the system in order to suppress interference noise appearing on an LCD screen. The circuit suggested includes mainly two semiconductor switches, impedance elements, and a diode to realize the synchronization function.

14 Claims, 4 Drawing Sheets

METHOD AND CIRCUIT FOR IMPROVING A QUALITY OF DISPLAY ON AN LCD SCREEN

BACKGROUND OF THE INVENTION

1. Field of the Invention

The present invention relates to a method and circuit for improving a quality of display on an LCD screen. More particularly, the present invention relates to a method of and circuit for synchronizing a vertical synchronization signal of the video signal supplied to an LCD system with an oscillation signal produced by a burst mode inverter in order to suppress interference noise appearing on an LCD screen.

2. Description of the Related Art

Producing an image using a liquid crystal display (LCD) is well known. LCD's are widely used for various applications including monitors, computers, televisions, and so on. The liquid crystal panel usually comprises a large number of individual liquid crystal pixel elements. Those pixel elements are beneficially organized in a matrix comprising pixel rows and pixel columns. Typically, the video signal is applied to the pixel elements by rows. A periodic vertical synchronization signal of the video signal is provided to scan all rows repeatedly. In one period of the vertical synchronization signal, all rows are successively scanned once. The number of times a pixel element of a column is scanned in a second is the frequency of the vertical synchronization signal.

An LCD system uses a backlight to illuminate the liquid crystal panel so as to produce an image. A backlight includes lamps, such as cold cathode fluorescent lamps (CCFL), for producing light. These lamps are typically powered by a DC-to-AC inverter. The inverter in turn is powered by another power source such as an LCD power supply. It converts a DC voltage to a high AC voltage required to drive the fluorescent lamp. One type of the DC-to-AC inverter is called burst mode inverter. The burst mode inverter generates oscillation waves to produce a square pulsating signal for dimming of the lamps. During the square pulses, the lamps are lighted through current. For example, FIG. 1 illustrates a voltage oscillation signal $V_{sawtooth}$, which is a sawtooth waveform, generated by a burst mode inverter, a burst pulsating signal resulting from the sawtooth wave, and the current signal $I_{lamp}$ flowing through the lamp. The burst signal is produced according to the oscillation signal $V_{sawtooth}$ compared with respect to a reference DC voltage Vr. When the voltage of the oscillation signal is above the reference voltage Vr, the burst signal is high. Otherwise the burst signal is low. Afterwards, the current lamp through the lamp is forced during the pulses of the burst signal. Besides, all lamps are driven in the same period and in synchronization with each other to reduce interference noise into the circuit of LCD from lamp or cables affecting display quality.

However, conventional LCD systems, especially multi-lamp LCD systems, still have interference noise problem. When the burst signal frequency of the burst mode inverter is equal or near the frequency of the vertical synchronization signal or its harmonics, a large interference noise will be generated periodically. This periodic noise will appear and disappear on the display screen and generates a so-called "ripple phenomenon". For instance, if the frequency of the vertical synchronization signal is 60 Hz, when the burst signal frequency of Inverter is 120, 180, 240 Hz or higher (harmonics of 60 Hz), significant noise will result. The burst signal frequency is often preferably set to be about 150 Hz or higher to avoid being close to the harmonics or flicker perceived by human eyes. However, the tolerance of the burst mode frequency could be big due to tolerances of temperature-dependent components, including especially capacitors, the controller or operational amplifier of the inverter. Therefore, the burst mode frequency is not very stable and the noise problem "ripple phenomenon" is still a concern. For the forgoing reasons, there is a need for solving the ripple phenomenon problem due to interference noise.

SUMMARY OF THE INVENTION

Accordingly, solving the ripple phenomenon problem due to interference noise is needed for systems, such as LCD displays, that include DC-to-AC inverters. Therefore, an object of the present invention is to provide a method of synchronizing a vertical synchronization signal of the video signal supplied to an LCD system with an oscillation signal produced by a burst mode DC-to-AC inverter driving the lamps of the system so as to reduce the noise. The result of the synchronization is such that the oscillation signal switches to a low value when the vertical synchronization signal switches state and the oscillation signal rises again and starts oscillation when later the vertical synchronization signal switches back to another state. Another object of the present invention is to provide a circuit for implementing the method.

A circuit according to the principles of the present invention includes the following components as an example. A first impedance element is connected to a supply voltage. A first semiconductor switch is connected to the first impedance element at a node and to a reference ground, having a first control terminal. A second impedance element is connected to the first control terminal and receives the vertical synchronization signal of a VGA controller. A second semiconductor switch is connected to a diode or none (short circuit) and to a reference ground, and has a second control terminal that is connected to the node, and the diode or none is connected to the oscillation signal of the Inverter. The supply voltage is at a voltage that can turn on the second semiconductor switch when applied to the second control terminal.

In conclusion, the invention enables the reduction of interference noise, including so-called ripple phenomenon, appearing on an LCD screen by providing the method as the solution and circuit for implementing it. Additional features and advantages will be set forth in the description that follows, and partly will be apparent from the description, or may be learned by practice of the invention.

It is to be understood that both the foregoing general description and the following detailed description are exemplary, and are intended to provide further explanation of the invention as claimed.

BRIEF DESCRIPTION OF THE DRAWINGS

FIG. 2(*b*) is the waveform of the vertical synchronization signal Sync;

FIG. 2(*c*) is the waveform of the synchronized oscillation signal $V_{sawtooth}$;

FIG. 2(*d*) is the waveform of the burst pulsating signal;

DESCRIPTION OF THE PREFERRED EMBODIMENTS

Figure 1:
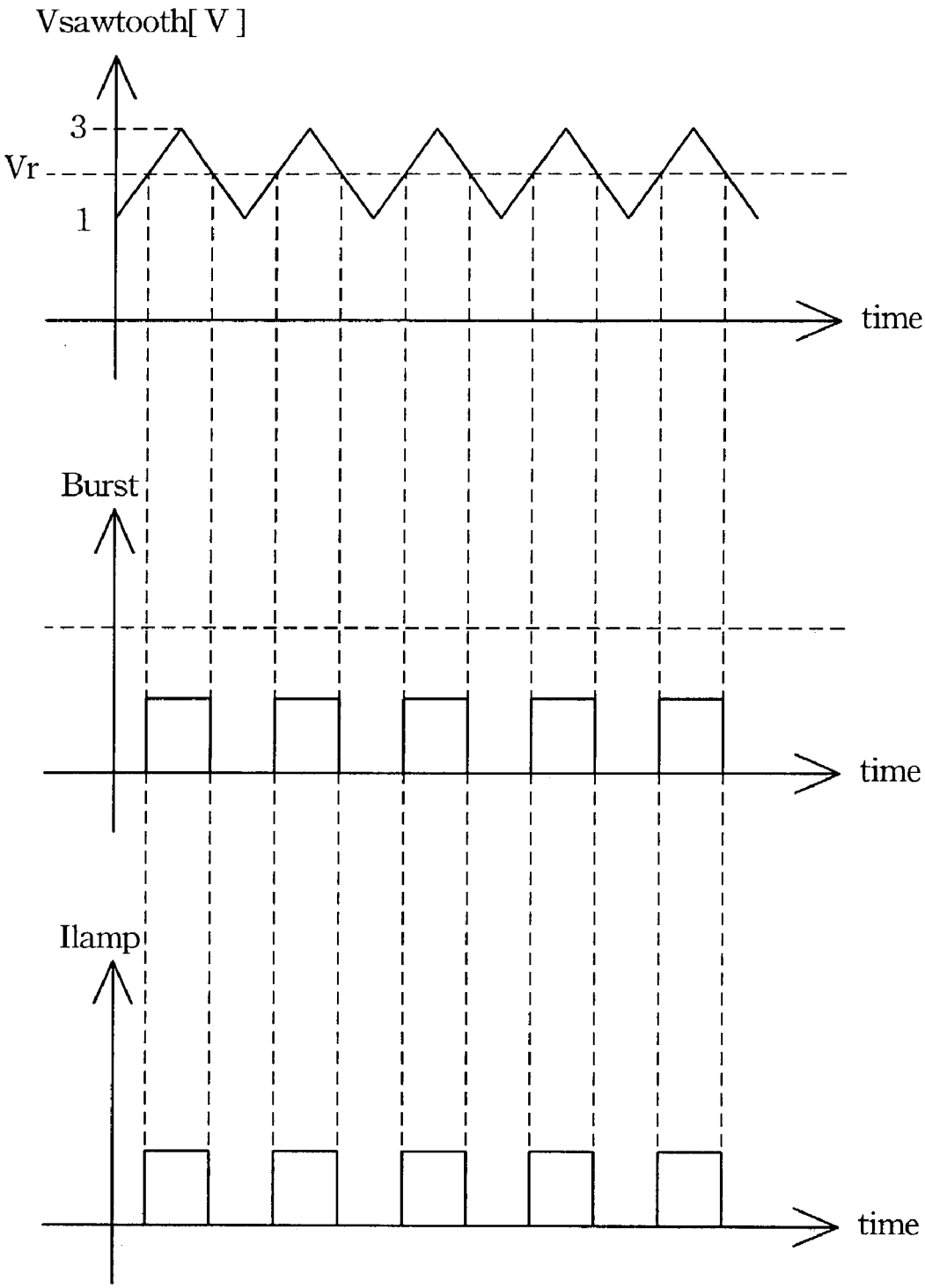
Fig. 1 (PRIOR ART)
FIG. 1 is the waveforms of the oscillation signal $V_{sawtooth}$, the burst pulsating signal, and the current signal $I_{lamp}$.
Figure 2A:
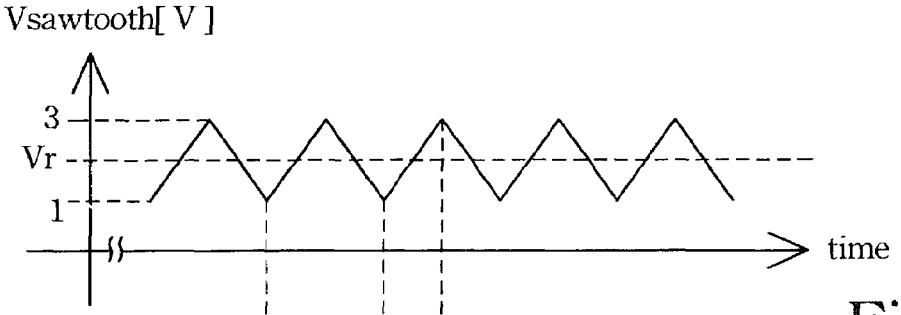
FIG. 2(*a*) is the waveform of the oscillation signal $V_{sawtooth}$.
Figure 2B:
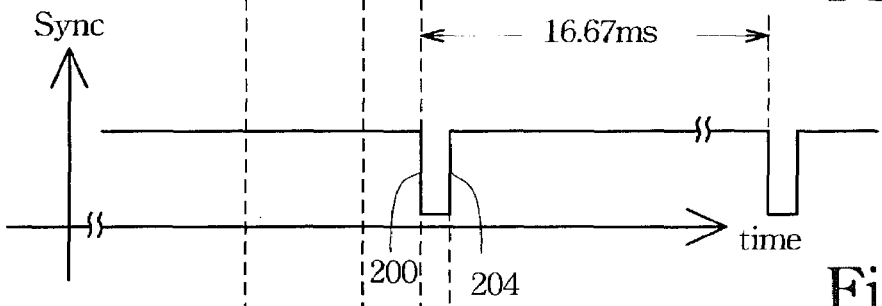
Figure 2C:
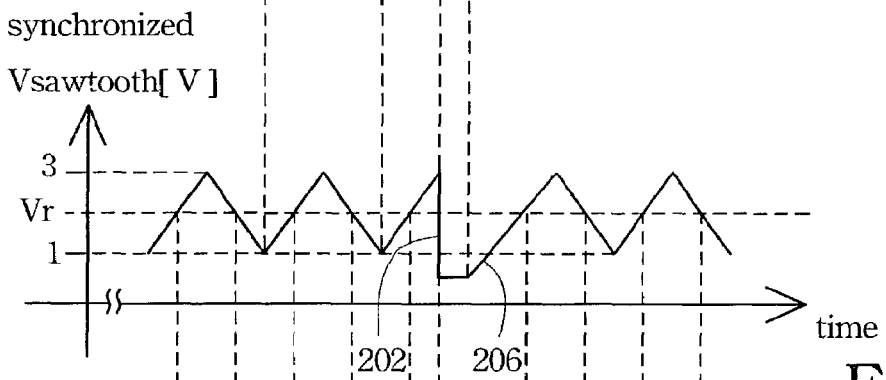
Figure 2D:
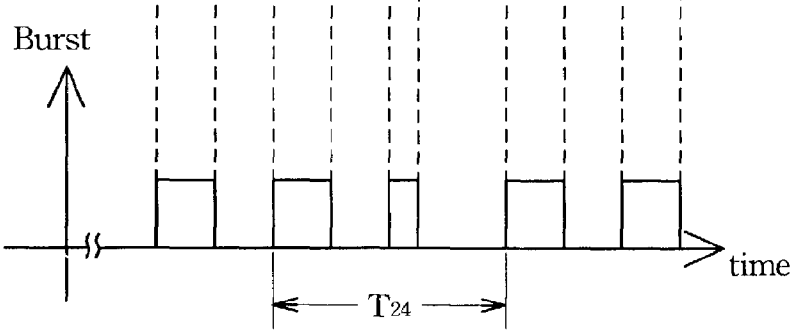

The method of the present invention is described and explained herein in more detail. A liquid crystal display (LCD) system includes a VGA type liquid crystal display panel containing the LCD pixel array, lamps for producing light that is directed onto the liquid crystal display panel, and a burst mode DC-to-AC inverter for driving the lamps. When the lamps are behind the LCD pixel array, the DC-to-AC inverter is often called a backlight inverter. For a VGA type liquid crystal display panel, there are 480 rows in the pixel array; that is 480 pixel elements in a column. A video signal is supplied to the LCD system. For instance, an oscillation signal Vsawtooth produced by the inverter for driving the lamps is the sawtooth waveform signal shown in FIG. 2(*a*) and its frequency is 210 Hz. Hence the period of Vsawtooth is about 4.76 ms (1/210 second, m=0.001, s stands for second). Since all lamps should be driven in the same period and in synchronization with each other, all oscillation signals for driving the lamps are the same and are synchronized with each other. The periodic vertical synchronization signal Sync of the video signal is shown in FIG. 2(*b*) and its frequency is 60 Hz. In other words, every pixel element of a pixel column is scanned 60 times in a second. The period of the signal Sync is thus about 16.67 ms (1/60 second).

The method is to synchronize the oscillation signal $V_{sawtooth}$ with the vertical synchronization signal Sync. Referring to the synchronized $V_{sawtooth}$ of FIG. 2(*c*), when the vertical synchronization signal Sync switches state (to a low value) indicated by 200, the original oscillation signal $V_{sawtooth}$ in FIG. 2(*a*) is forced to switch to a low value, indicated by 202. When later on the vertical synchronization signal Sync switches state again (back to a high value) indicated by 204, the oscillation signal $V_{sawtooth}$ in FIG. 2(*c*) rises again and starts its oscillation, indicated by 206. The burst signal is produced according to the synchronized oscillation signal $V_{sawtooth}$ compared with respect to a reference DC voltage Vr and is shown in FIG. 2(*d*). When the voltage of the synchronized oscillation signal is above the reference voltage Vr, the burst signal is high. Otherwise the burst signal is low. Afterwards, the current through the lamps is forced during the pulses of the burst signal.

Alternatively, if the waveform of the vertical synchronization signal Sync is the type that is reverse to that shown in FIG. 2(*b*); that is, durations of the high value state become durations of the low value state and durations of the low value state become durations of the high value state, the original oscillation signal $V_{sawtooth}$ in FIG. 2(*a*) will be pulled down to a low value when the vertical synchronization signal Sync switches state to a high value and later on the oscillation signal $V_{sawtooth}$ will rise again when the vertical synchronization signal Sync switches state to a low value.

Note if there were no synchronization between the two signals $V_{sawtooth}$ and Sync, the frequency of the burst signal would be the same as that of the original oscillation signal $V_{sawtooth}$ and is equal to 210 Hz. Therefore its period would be about 4.76 ms (1/210 second). Instead after the synchronization step, the width of the third pulse of the burst signal is narrower than other pulses as shown in FIG. 2(*d*), and the time $T_{24}$ between the second and the fourth pulses is less than 2 times the original period (4.76 ms times 2 is 9.52 ms). The total a verage current through the lamp during every period of the 60 Hz vertical synchronization signal Sync is the same.

Note also that when every time the vertical synchronization signal Sync switches state, the low value to which the original oscillation signal $V_{sawtooth}$ is pulled down may not be close to 0 volt. A low value close to 0 volt will affect the maximum duty cycle of the burst signal achievable if the minimum voltage of normal oscillation signal is higher than 0V. Thus the low value is suitably set to be lower than the minimum value of the original oscillation signal $V_{sawtooth}$ a little bit. The maximum duty cycle should be more than 95% to keep enough image display brightness for the same root-mean-squared value of lamp current according to specifications of the LCD system.

Figure 3:
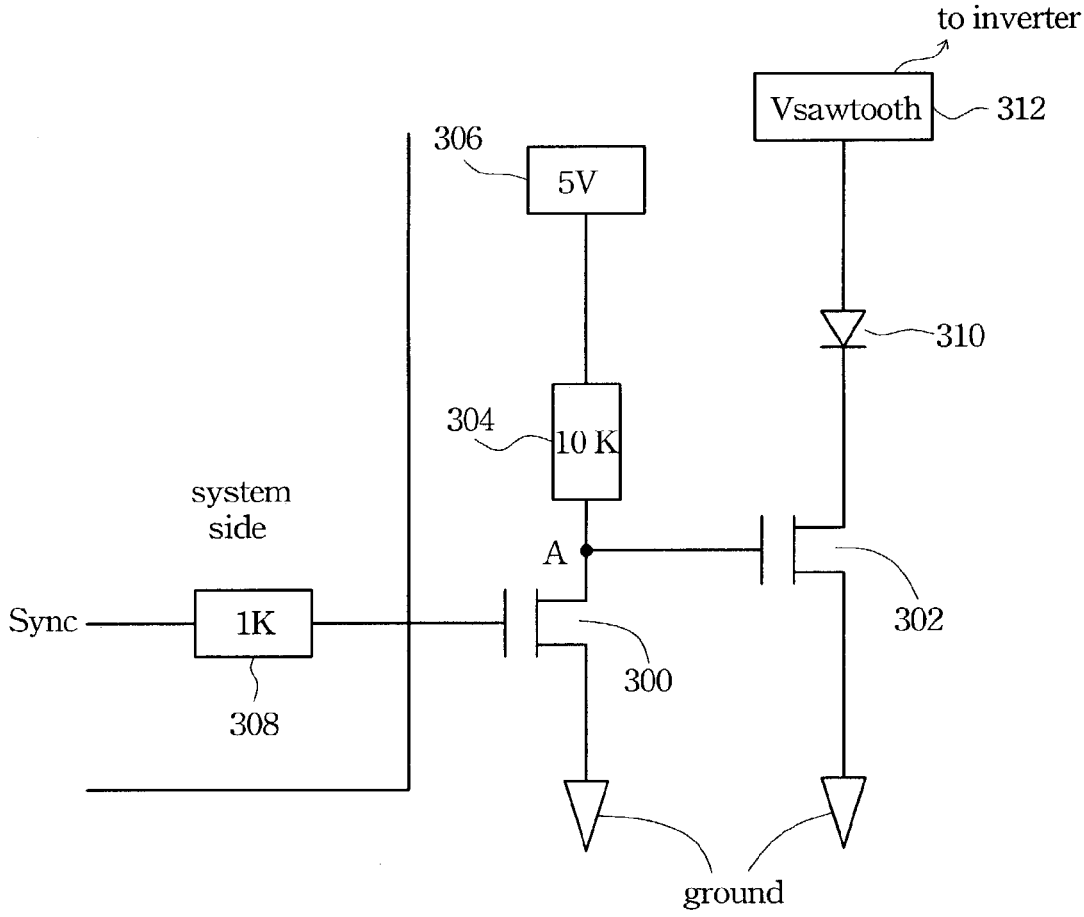
FIG. 3 is a circuit diagram for implementing the method of the invention.

A circuit suggested by the present invention for implementing the above-mentioned method is described here. The circuit is shown in FIG. 3. In this circuit, two NMOS (N type metal oxide semiconductor) field effect transistors 300 and 302 are used as switches. The first transistor 300 is connected to a resistor 304 of 10 kilo-ohm at a node A and connected to a reference ground. The 10 kilo-ohm resistor 304 is then connected to a DC voltage of 5 volt. The DC voltage may be from a power supply and must be able to turn on the second transistor 302 when applied to its control terminal. The control terminal of the first transistor 300 receives the vertical synchronization signal Sync shown in FIG. 2(*b*) through a resistor 308 of 1 kilo-ohm. The second transistor 302 is connected to a diode 310 and connected to the reference ground. The diode 310 is then connected to the original oscillation signal $V_{sawtooth}$ 312, which is associated with the backlight inverter. The control terminal of the second transistor 302 is connected to the node A.

The operation principle of the circuit is as follows. When the vertical synchronization signal Sync switches state to a low value, the first transistor 300 is turned off, so the voltage at node A is about 5 volts, thereby the second transistor 302 is turned on. Therefore, the original oscillation signal $V_{sawtooth}$ 312 is pulled down to a low value clamped as the forward voltage across the diode 310. The diode 310 is used to prevent the original oscillation signal $V_{sawtooth}$ from being pulled down to a zero value. On the other hand, when later on the vertical synchronization signal Sync switches state again (back to a high value), the first transistor 300 is turned on, causing the voltage at node A to be at ground, thereby the second transistor 302 is turned off. As a result of this, the oscillation signal $V_{sawtooth}$ rises and starts its oscillation again. In conclusion, this circuit achieves the purpose of synchronization between the two signals.

Figure 4:
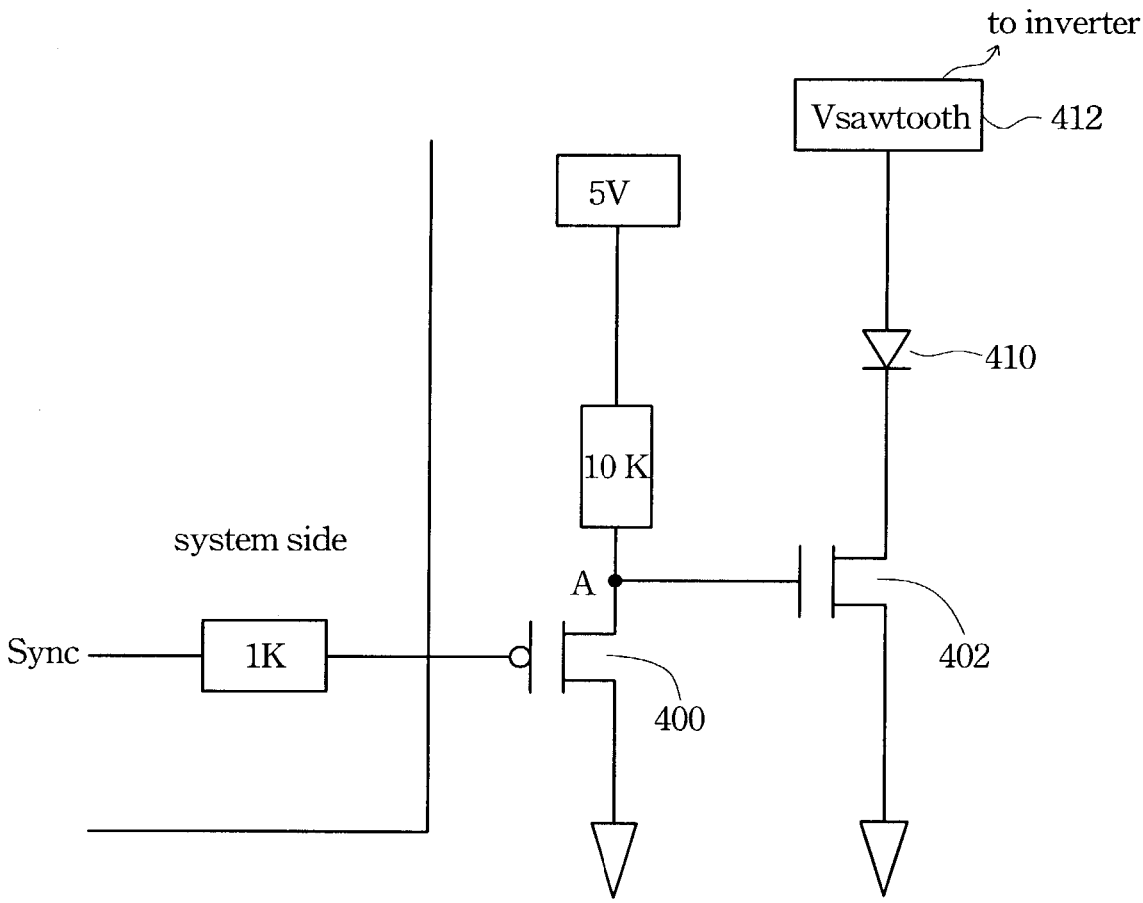
FIG. 4 is another circuit diagram for implementing the method of the invention.

Note that if the waveform of the vertical synchronization signal Sync is reversed as the previously mentioned possibility, then the circuit in FIG. 3 can be modified to include a PMOS (p type MOS) field effect transistor in lieu of the first transistor 300. This is shown in FIG. 4. The operation principle of the circuit is described as follows. When the vertical synchronization signal Sync switches state to a high value, the first transistor 400 is turned off, so the voltage at node A is about 5 volts, thereby the second transistor 402 is turned on. Therefore, the original oscillation signal $V_{sawtooth}$ 412 is pulled down to a low value equal to the small forward bias voltage drop across the diode 410. When later on the vertical synchronization signal Sync switches state again (back to a low value), the first transistor 400 is turned on, causing the voltage at node A to be at ground, thereby the second transistor 402 is turned off. As a result of this, the oscillation signal $V_{sawtooth}$ rises and starts its oscillation again.

Another possible implementation of the invention is an LCD system with improved quality of display on the LCD screen. The LCD system is supplied with a video signal and a vertical synchronization signal. It contains essential components including a liquid crystal display panel with pixel elements arranged in a matrix, lamps for producing light that's directed to the liquid crystal display panel, a DC-to-AC inverter producing an oscillation signal for driving the lamps, and the same circuit as described above for synchronizing the vertical synchronization signal with the oscillation signal.

While there has been described in considerable detail the method and circuit of the present invention, it will be understood that various modifications may be made with regard to, for example, signal waveforms and numerical values, and it is intended that the appended claims cover all such modifications as fall within the true spirit and scope of the invention.

What is claimed is:

1. A circuit to be used in a liquid crystal display (LCD) system for synchronizing a vertical synchronization signal of the video signal supplied to the LCD system with an oscillation signal produced by a burst mode DC-to-AC inverter driving a lamp of the LCD system, the circuit comprising:

a first impedance element connected to a high voltage line;

a first semiconductor switch connected to said first impedance element at a node, and connected to a reference ground, said first semiconductor switch including a first control terminal;

a second impedance element connected to said first control terminal and receiving said vertical synchronization signal;

a second semiconductor switch connected to a reference ground, said second semiconductor switch including a second control terminal, said second control terminal connected to said node; and a diode receiving said oscillation signal and connected to said second semiconductor switch.

2. The circuit of claim 1, wherein said high voltage line receives a DC voltage from a power supply that can turn on said second semiconductor switch when applied to said second control terminal.

3. The circuit of claim 1, wherein said first semiconductor switch is a field effect transistor.

4. The circuit of claim 1, wherein said second semiconductor switch is a field effect transistor.

5. The circuit of claim 1, wherein the impedance of said first impedance element is 10 kilo-ohm.

6. The circuit of claim 1, wherein the impedance of said second impedance element is 1 kilo-ohm.

7. A liquid crystal display supplied with a video signal and a vertical synchronization signal thereof, said vertical synchronization signal having a first state and a second state, the liquid crystal display comprising:

a liquid crystal display panel having a plurality of pixel elements arranged in a matrix;

at least one lamp for producing light that's directed to said liquid crystal display panel;

a DC-to-AC inverter producing an oscillation signal for driving said at least one lamp; and a circuit for synchronizing said vertical synchronization signal with said oscillation signal such that said oscillation signal switches to a low value when said vertical synchronization signal switches from the first state to the second state and said oscillation signal rises again and starts oscillation when later on said vertical synchronization signal switches back to the first state, comprising:

a first impedance element connected to a high voltage line;

a first semiconductor switch connected to said first impedance element at a node, and connected to a reference ground, said first semiconductor switch including a first control terminal;

a second impedance element connected to said first control terminal and receiving said vertical synchronization signal;

a second semiconductor switch connected to a reference ground, said second semiconductor switch including a second control terminal, said second control terminal connected to said node; and a diode receiving said oscillation signal and connected to said second semiconductor switch.

8. The liquid crystal display of claim 7, wherein said first state of said vertical synchronization signal is a high state and said second state is a low state.

9. The liquid crystal display of claim 7, wherein said first state of said vertical synchronization signal is a low state and said second state is a high state.

10. The liquid crystal display of claim 7, wherein said high voltage line receives a DC voltage from a power supply that can turn on said second semiconductor switch when applied to said second control terminal.

11. The liquid crystal display of claim 7, wherein said first semiconductor switch is a field effect transistor.

12. The liquid crystal display of claim 7, wherein said second semiconductor switch is a field effect transistor.

13. The liquid crystal display of claim 7, wherein the impedance of said first impedance element is 10 kilo-ohm.

14. The liquid crystal display of claim 7, wherein the impedance of said second, impedance element is 1 kilo-ohm.

* * * * *